United States Patent [19]

Tone

[11] 4,133,334

[45] Jan. 9, 1979

[54] FLIPPER TYPE ARROW REST

[76] Inventor: Richard D. Tone, 705 N. Pineda, Jacksonville, Tex. 75766

[21] Appl. No.: 764,637

[22] Filed: Feb. 1, 1977

[51] Int. Cl.[2] ..... F41D 9/00

[52] U.S. Cl. ..... 124/41 A; 124/24 R

[58] Field of Search ..... 124/41 A, 24 R, 88, 124/86; 124/31

[56] References Cited

U.S. PATENT DOCUMENTS

| | | | |
|---|---|---|---|
| 3,108,584 | 10/1963 | Coe | 124/24 R |
| 3,285,237 | 11/1966 | Wolfe | 124/41 A |
| 3,292,607 | 12/1966 | Hoyt | 124/24 R X |
| 3,672,347 | 6/1972 | Allen | 124/24 R X |
| 3,769,956 | 11/1973 | Simo | 124/24 R X |
| 3,828,757 | 8/1974 | Finlay | 124/24 R X |

*Primary Examiner*—Richard C. Pinkham

*Assistant Examiner*—William R. Browne

*Attorney, Agent, or Firm*—Richards, Harris & Medlock

[57] ABSTRACT

An arrow supporting device for use with an archery bow which includes a mounting plate adapted to be affixed to the archery bow, and a closed loop spring member having two ends pivotally attached at the ends to the mounting plate. The closed loop spring member is biased to extend laterally of the mounting plate in order to support an arrow in a predetermined relationship to the archery bow as the arrow is readied for release. The closed loop spring member is movable towards the mounting plate to permit the stabilizing structure of the arrow to clear the arrow supporting device with a minimum of resistance to minimize arrow deflection. Said loop spring member includes two spaced apart arms.

11 Claims, 5 Drawing Figures

FLIPPER TYPE ARROW REST

FIELD OF THE INVENTION

This invention relates to arrow rest for archery bows, and more particularly to a flipper type arrow rest capable of both horizontal and vertical flexing movement.

THE PRIOR ART

In archery competition, as well as in bow hunting, accurate marksmanship is important and precise control of the various parameters affecting the accuracy of arrow flight is critical. Various mechanical aids have thus been heretofore developed for use by archery marksmen to improve accuracy. One such device is an arrow rest for properly positioning an arrow prior to release from the bow string. Such arrow rest serve to assist in aiming the arrow, but it is important that the rests not interfere with the stabilizing feathers or vanes of the arrow as the arrow passes by the arrow rest.

Several arrow rests have been previously utilized by archers. These prior art rests have often included a ledge or shelf that may be an integral part of the bow or a similarly shaped bracket temporarily or permanently secured to the side of the bow. Other available arrow rests are quite complicated and involve several shafts and separate springs for adjustable positioning of an arrow prior to ejection. Existing arrow rests are usually expensive in cost, difficult to install and often consist of several associated component parts of metal or plastic that affect the balance of the bow and which require frequent replacement. Examples of prior arrow rests are described in U.S. Pat. Nos. 3,865,096 and 3,919,997.

A need has thus arisen for an arrow rest for providing proper positioning of the arrow prior to release from a bow string yet which offers minimum resistance to the arrow stabilizing structure as the arrow transverses the bow. A need has further arisen for an arrow rest which suppresses or compensates for vertical arrow oscillations while also reducing archer's paradox. Such an arrow rest should have a simple contruction to minimize cost and maintenance related problems, while being light in weight as to not affect the balance of the archery bow.

SUMMARY OF THE INVENTION

The present invention is directed to an arrow rest for providing proper positioning of the arrow prior to release from the bow string and for reducing vertical arrow oscillations and archer's paradox, and which substantially eliminates or reduces the disadvantages associated with prior art arrow rests.

In accordance with the present invention, an arrow supporting device is provided for use with an archery bow and arrows having stabilizing structure attached to the rear portion of the arrows. The device includes a mounting member adapted to be affixed to the bow. A closed loop member is provided and is pivotally attached to the mounting member. The closed loop member is biased to extend laterally of the mounting member into an arrow receiving and supporting position to support an arrow in a predetermined angular spaced relationship to the archery bow when the arrow is readied for release. The closed loop member is also retractable towards the mounting member to thereby permit the stabilizing structure of the arrow to clear the arrow supporting device with a minimum of resistance to thereby minimize arrow deflection as the arrow transverses the bow.

In accordance with another aspect of the present invention, an arrow supporting device is provided for use with an archery bow having a plunger device and with arrows having a stabilizing structure attached to the rear portion of the arrows. The arrow supporting device includes a flexible mounting plate which is adapted to be affixed to the bow and which includes an aperture for receiving the plunger device. A closed loop wire is provided with first and second arm members which are independently compressible and expandable. The first and second arm members include first and second ends extending substantially normal to the arm members. First and second cylindrical pivot housings are rigidly affixed to and are laterally offset on the flexible mounting plate for receiving the closed loop wire ends, such that the wire ends are rotatable within the cylindrical pivot housings. The first and second arm members of the closed loop wire lie at a predetermined angular spaced relationship to one another and are capable of being vertically flexed for vertical positioning and for cushioning of an arrow against the cushion plunger device. One of the arm members includes a stop for biasing the closed loop wire to extend laterally of the flexible mounting plate into an arrow receiving and supporting position to support the arrow at a predetermined angular spaced relationship horizontal to the archery box when the arrow is ready for release. The closed loop wire is also horizontally retractable towards the flexible mounting plate as the arrow is released to thereby permit the arrow stabilizing structure to clear the arrow supporting device as the arrow transverses the bow to minimize deflection of the arrow in flight. An adhesive is applied to the flexible mounting plate for affixing the flexible mounting plate to the bow. A removable paper covering is attached to the adhesive for protecting the adhesive prior to affixing the flexible mounting plate to the archery bow.

DESCRIPTION OF THE DRAWINGS

For a more complete understanding of the present invention and for further objects and advantages thereof, reference is now made to the following description taken in conjunction with the accompanying drawings, in which.

DESCRIPTION OF THE PREFERRED EMBODIMENT

Figure 1:
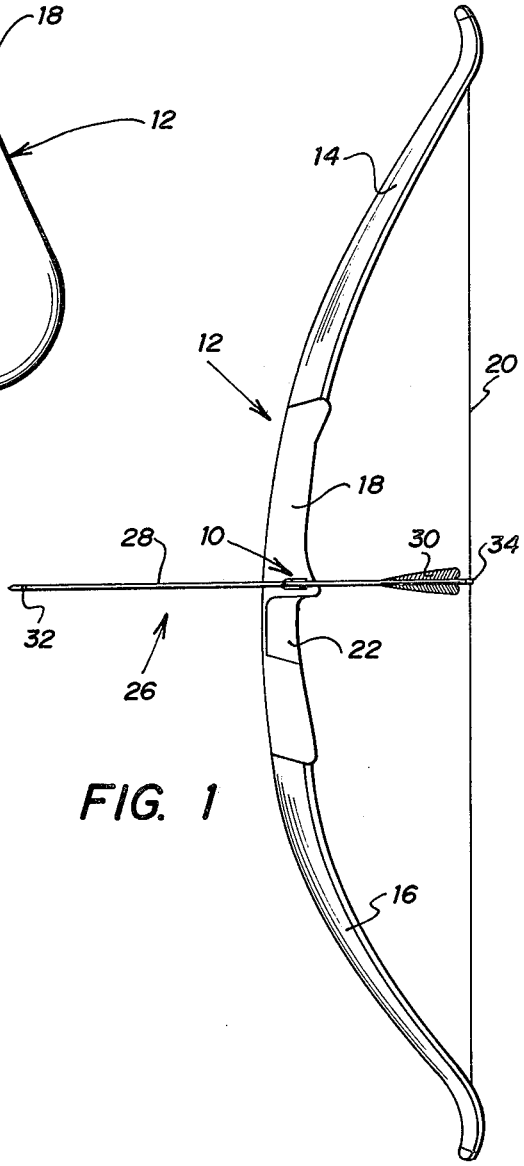
FIG. 1 is a side elevation view of a conventional archery bow showing the arrow rest of the present invention.

Referring to FIG. 1, the arrow rest of the present invention is illustrated and is identified generally by the numeral 10. The arrow rest 10 is attached to the proper location at the spine point of a conventional archery bow identified generally by the numeral 12. The archery bow 12 includes upper and lower limbs 14 and 16 and a handle riser section 18. The archery bow 12 is provided with the usual bow string 20 and a contoured hand grip portion 22 that is located just below the spine-point of the bow 12. It will of course be understood that the arrow rest 10 can also be used on more complex archery bows. FIG. 1 further illustrates a conventional arrow identified generally by the numeral 26 having a shaft 28 and fletchings 30. Fletchings 30 may comprise conventional feathers or plastic vanes, which provide a stabilizing structure for the arrow 26 in flight. The arrow 26 further includes a point 32 and nock 34 for engaging the bow string 20.

Figure 2:
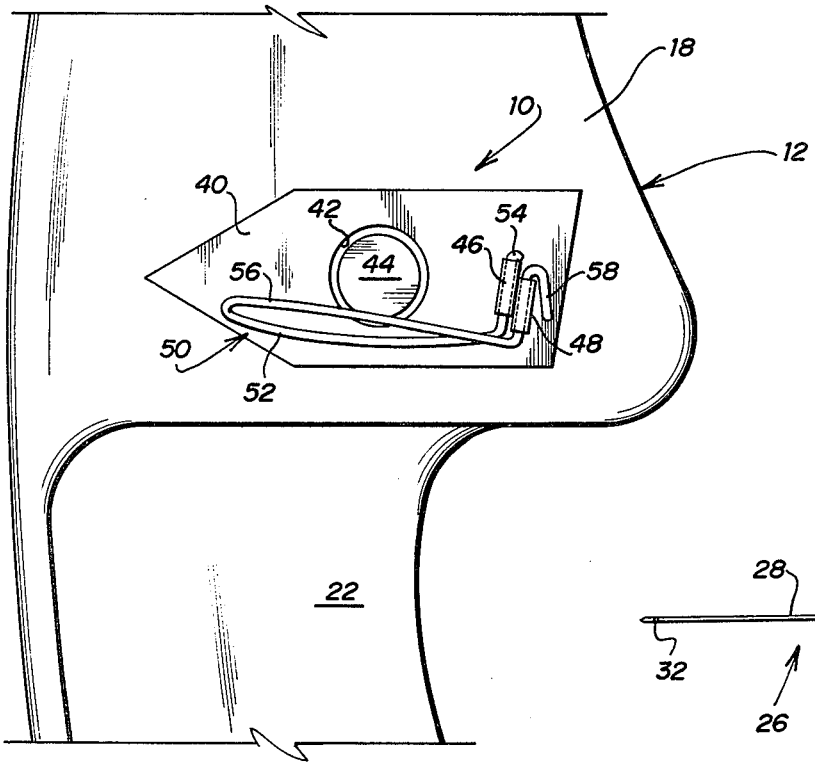
FIG. 2 is an enlarged fragmentary side elevation view of a portion of the archery bow shown in FIG. 1 illustrating one embodiment of the arrow rest of the present invention.
Figure 3:
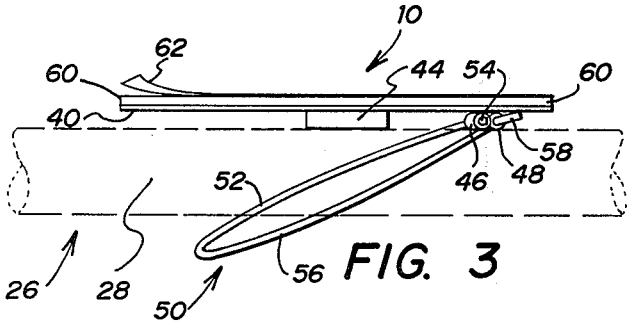
FIG. 3 is a top plan view of the arrow rest of the present invention shown in FIG. 2 illustrating the closed loop in the lateral extended position.
Figure 4:
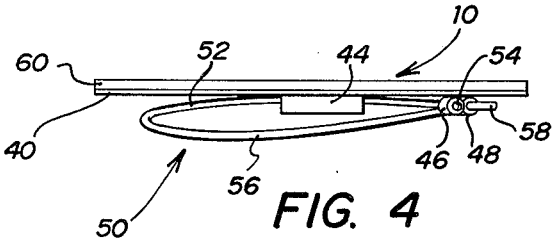
FIG. 4 is a top plan view of the arrow rest of the present invention shown in FIG. 2 illustrating the closed loop in the retracted position.

Referring simultaneously to FIGS. 2, 3 and 4, wherein like numerals are utilized for like and corresponding parts, the illustrated embodiment of the arrow rest 10 includes a mounting plate 40. Mounting plate 40 includes an aperture 42 for receiving a plunger cushion button 44. The plunger cushion button 44 is part of a conventional plunger device (not shown), which may be installed in the side wall of the handle riser section 18 (FIG. 1) of the bow 12. The mounting plate 40 is preferably fabricated of brass, anodized aluminum or the like to preclude the damaging effects of rust. The mounting plate 40 is positioned such that its longitudinal axis lies parallel to the direction of flight of the arrow 26. This placement of the mounting plate 40 minimizes the resistance offered by the arrow rest 10 to the fletchings 30 as the arrow 26 is shot from the bow 12.

Rigidly affixed to the mounting plate 40 are cylindrical pivot housings 46 and 48. The cylindrical pivot housing 46 and 48 are slightly vertically offset and parallel oriented to one another to receive the ends of a closed loop wire identified generally by the numeral 50. The closed loop wire 50 includes an inner arm member 52 having an end 54 and an outer arm member 56 having an end 58. The ends 54 and 58 of the closed loop wire 50 are received in the cylindrical pivot housings 46 and 48 such that the closed loop wire 50 is pivotally attached to the mounting plate 40. The closed loop wire 50 is capable of movement between an arrow receiving and supporting position shown in FIG. 3 and a retracted position shown in FIG. 4 to allow the fletchings 30 to pass by unimpeded.

The end 58 of the outer arm member 56 extends outwardly and downwardly of the cylindrical pivot housing 48 to contact the surface of the mounting plate 40 when the closed loop wire 50 is in the arrow receiving and supporting position. The arm members 52 and 56 are held in a slightly biased position by the housings 46 and 48 to bias the closed loop wire 50 outwardly of the mounting plate 40 to receive the shaft 28 of arrow 26. The end 58 of outer arm member 56 abuts against the mounting plate 40 to determine the angular position of the closed loop wire 50 when it is in the arrow receiving an supporting position shown in FIG. 3. The position of the end 58, which acts as a stop member, changes the spaced relationship between the closed loop wire 50 and the mounting plate 40 to accommodate different size diameter arrow shafts.

The cylindrical pivot housings 46 and 48 are laterally offset on the mounting plate 40, which together with the angular displacement of the arms 52 and 56, cause the closed loop wire 50 to slant downwardly at a predetermined angle towards the mounting plate 40. This slant between the closed loop wire 50 and the mounting plate 40 causes the arrow to be positioned and cradled against the plunger cushion button 44 to securely position the arrow 26 prior to its release. The positions of the cylindrical pivot housings 46 and 48 are such that they offer a minimum of resistance to the fletchings 30 as the arrow 26 transverses the bow 12.

By maintaining the position of the arrow shaft 28 against the plunger cushion button 44, the closed loop wire 50 tends to compensate for and minimize horizontal arrow bowing and flexing, commonly termed horizontal paradox, associated with the flight of the arrow when released from the tensed bow string 20 (FIG. 1). The resiliency of the closed loop wire 50 also provides a spring effect to cushion and eliminate bounces, or vertical paradox, from the arrow 26 as it transverses the bow 12. As is known, such arrow bouncing can be caused by improperly tillered bows where the top and bottom limbs are misaligned.

Another important aspect of the present invention is that the closed loop wire 50 is self-biased or stressed such that one arm member stretches and the other arm member compresses as the loop wire 50 pivots between the extended position shown in FIG. 3 and the retracted position shown in FIG. 4. The self-biasing of the loop wire 50 causes the loop wire 50 to pivot inwardly to accommodate the arrow flechings, and then to automatically spring back to the outward position shown in FIG. 3. This feature of the closed loop wire 50 eliminates the need of additional separate springs and components to extend the arrow rest after passage of an arrow. As noted, the spring effect of the closed loop wire 50 is created by the initial biasing of the arms 52 and 56 and because the inside arm 52 compresses while the outside arm 56 stretches as the loop wire 50 is moved inwardly by the passage of the arrow.

The closed loop wire 50 is preferably fabricated of light gauge stainless steel wire, which has sufficient horizontal and vertical resiliency and strength to apply the necessary pressure and support to the arrow shaft 28, and which can withstand repeated usage. The closed loop wire 50 may also comprise stainless steel wire coated with graphite, or other suitable materials. Depending upon the archery bow weight, draw length and other bow parameters, the diameter of the closed loop wire 50 may be selected from about 0.025 inches to about 0.032 inches.

Referring to FIG. 3, the mounting plate 40 is provided on its rear surface with a conventional adhesive coating 60 for affixing the arrow rest 10 to the surface of the bow 12. A lightly adhering, removable paper covering 62 is provided to temporarily protect the adhesive 60 prior to affixing the arrow rest 10 to the bow 12. Of course, the plate 40 may also be attached by conventional mounting techniques.

Figure 5:
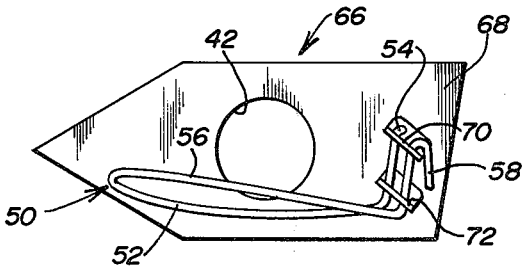
FIG. 5 is a side elevation view of a second embodiment of the arrow rest of the present invention.

FIG. 5 illustrates a second embodiment of the present invention, identified generally by the numeral 66. Like numerals are utilized in FIG. 5 for like and corresponding parts previously identified. The arrow rest 66 includes a mounting plate 68 including an aperture 42 for receiving a plunger cushion button (not shown). The mounting plate 68 includes two flanges 70 and 72 formed by a stamping operation which each include two apertures for receiving the ends 54 and 58 of the closed loop wire 50. The flanges 70 and 72 function similarly to the housings 46 and 48 previously described in connection with FIGS. 2, 3 and 4.

Although the mounting plates 40 and 68 have been illustrated having a particular configuration, other shapes and configurations may be utilized. The mounting plates 40 and 68 need not include an aperture 42 for those archery bows which do not utilize plunger devices. It will also be understood that the present arrow rest can be manufactured to accommodate both right and left-handed archery bows.

Whereas the present invention has been described with respect to specific embodiments thereof, it will be understood that various changes and modifications will be suggested to one skilled in the art, and it is intended to encompass such changes and modifications as fall within the scope of the appended claims.

What is claimed is:

1. For use with an archery bow and arrow, an arrow rest comprising:

a mounting member adapted to be fixed to an bow;

a flexible closed loop means dimensioned to support an arrow and having two ends which extend substantially normal to said loop means;

means for pivotally attaching said loop means to said mounting member which includes first and second pivot structures rigidly attached to said mounting member for pivotally receiving said two ends of said loop means, such that said two ends of said loop means are rotatable relative to said pivot structure; and said closed loop means being bent relative to the ends thereof such that said means is biased laterally outwardly of said mounting member into an arrow-receiving and supporting position to support an arrow in a predetermined angular spaced relationship to an archery bow when an arrow is readied for release, and said closed loop means being pivotable toward said mounting member about the ends thereof to thereby permit a released arrow to clear an arrow rest with a minimum of resistance to minimize arrow deflection, said closed loop member in retracted position thereby biased to pivot automatically to arrow-receiving and supporting position.

2. The arrow supporting device of claim 1 wherein one of said loop member ends includes:

a stop means extending from one of said pivot structures for contacting said mounting member to thereby restrict the lateral extension of said loop means from said mounting member.

3. The arrow supporting deivce of claim 1 wherein said closed loop means is formed from a resilient metal wire.

4. The arrow supporting device of claim 1 and further including:

adhesive means applied to said mounting member for affixing said mounting member to an archery bow; and a removable paper covering attached to said adhesive means for protecting said adhesive means prior to affixing said mounting member to an archery bow.

5. The arrow supporting device of claim 1 wherein said closed loop means is attached to said pivot housing member at a predetermined angle to said mounting member to cradle arrows toward a bow.

6. The arrow supporting device of claim 1 wherein said first and second pivot structures are laterally offset from each other on said mounting member.

7. An arrow supporting device for use with an archery bow and arrows having stabilizing structure attached to the rear portion of the arrows, the arrow supporting device comprising:

a mounting plate adapted to be affixed to an bow;

a closed loop spring means having first and second arm members being independently compressible and expandable and having first and second ends extending from said arm members;

means for pivotally attaching said closed loop spring means to said mounting plate including first and second pivot members rigidly affixed to said mounting plate for receiving said closed loop spring means ends such that said closed loop spring means ends are rotatable in said pivot members, said first and second arm members lying at a predetermined angular spaced apart relationship to one another and being capable of being vertically flexed for vertical positioning and cushioning of an arrow against said mounting plate;

said arm members being bent relative to the ends of said spring mechanism such that said closed loop spring means is biased laterally outwardly of said mounting plate into an arrow receiving and supporting position to support an arrow at a predetermined angular spaced relationship horizontal to the archery bow as the arrow is readied for release; and said arms being pivotable about said ends said closed loop spring means being movable towards said mounting plate as an arrow is released to thereby permit an arrow stabilizing structure to clear an arrow supporting device as an arrow traverses an archery bow to minimize deflection of an arrow in flight.

8. The arrow supporting device of claim 7 wherein:

one of said arm members being bent to abut against said mounting plate to define the outermost position of said closed loop spring means.

9. An arrow supporting device for use with an archery bow having a plunger device and arrows having stabilizing structure attached to the rear portion thereof, an arrow supporting device comprising:

a plunger device;

a flexible mounting plate having a longitudinal axis and including an aperture for receiving the plunger device and being adapted to be affixed to an archery bow;

a closed loop wire having first and second arm members, said arm members being biased to normally position said loop wire laterally outwardly of said mounting plate and further having first and second ends extending substantially normal to said arm members;

first and second pivot housings rigidly affixed to said flexible mounting plate for receiving said closed loop wire ends, such that said closed loop wire is rotatably mounted within said cylindrical pivot housings to said flexible mounting plate;

said first and second arms of said closed loop wire lying at a predetermined angular spaced relationship to one another and capable of being vertically flexed for vertically positioning and cushioning an arrow while urging the arrow against the plunger device;

one of said arm members including stop means for positioning said closed loop wire at a desired arrow receiving and supporting position to support an arrow at a predetermined angular spaced relationship horizontal to an archery bow when an arrow is readied for release; and said closed loop wire also being movable towards said flexible mounting plate as an arrow is released to thereby permit an arrow stabilizing structure to clear the arrow supporting device as an arrow transverses the archery bow to minimize deflection of an arrow in flight.

10. The arrow supporting device of claim 9 wherein said closed loop wire has a diameter from about 0.025 inches to about 0.032 inches.

11. The arrow supporting device of claim 9 wherein said flexible mounting plate is affixed to an archery bow such that said longitudinal axis of said mounting plate lies parallel to the direction of the flight of an arrow to minimize resistance offered by the supporting device to an arrow stabilizing structure as an arrow transverses an archery bow.

* * * * *